US005899176A

United States Patent [19]

Kern et al.

[11] Patent Number: 5,899,176

[45] Date of Patent: May 4, 1999

[54] APPARATUS FOR REDUCING ENGINE FAN NOISE

[75] Inventors: Robert D. Kern; Andrew B. Robson, both of Waukesha; Gerald C. Ruehlow, Oconomowoc; Peter D. Winnie, Jefferson, all of Wis.

[73] Assignee: Generac Corporation, Waukesha, Wis.

[21] Appl. No.: 09/019,624

[22] Filed: Feb. 6, 1998

[51] Int. Cl.[6] ..... F01P 5/04; F01P 5/12

[52] U.S. Cl. ..... 123/41.49; 123/41.46

[58] Field of Search ..... 123/198 R, 141.49, 123/41.11, 41.12, 41.46

[56] References Cited

U.S. PATENT DOCUMENTS

| | | | |
|---|---|---|---|
| 2,173,661 | 9/1939 | Perrine | 123/171 |
| 2,607,327 | 8/1952 | Lee, II | 123/41.11 |
| 2,911,962 | 11/1959 | McRae | 123/41.11 |
| 2,916,024 | 12/1959 | Dodge | 124/41.11 |
| 2,917,937 | 12/1959 | Dodge | 74/336 |
| 2,948,268 | 8/1960 | Roper et al. | 123/41.11 |
| 2,995,295 | 8/1961 | Day | 230/270 |
| 3,081,642 | 3/1963 | Emerson | 74/230.17 |
| 3,096,662 | 7/1963 | McRae | 74/336 |
| 3,763,835 | 10/1973 | Miller et al. | 123/41.11 |
| 3,872,842 | 3/1975 | Medley | 123/41.12 |
| 4,215,658 | 8/1980 | Smith, Jr. et al. | 123/41.44 |
| 4,441,462 | 4/1984 | Budinski | 123/41.11 |
| 5,199,539 | 4/1993 | Kikuchi | 192/60 |
| 5,518,460 | 5/1996 | White, Jr. et al. | 474/139 |

*Primary Examiner*—Andrew M. Dollnar
*Assistant Examiner*—Arnold Castro
*Attorney, Agent, or Firm*—Janssn, Shupe, Bridge & Munger, Ltd.

[57] ABSTRACT

An apparatus has first and second driven pulleys for powering an engine auxiliary function, e.g., a water pump, and for driving an engine fan, respectively. The apparatus includes a hollow tube-like arbor fixed with respect to the first pulley and having a first arbor surface, e.g., an exterior cylindrical surface. A bearing has a first load-supporting surface, e.g., the interior surface of the bearing, which is mounted to the first arbor surface. A fan drive member is mounted to the second load-supporting surface of the bearing, e.g., the exterior bearing surface, and both the fan and the second pulley are coupled to the fan drive member. The two pulleys are driven by respective belts powered by the engine crankshaft and the pulleys rotate in opposite directions when driven. A new engine incorporating the apparatus is also disclosed.

13 Claims, 4 Drawing Sheets

APPARATUS FOR REDUCING ENGINE FAN NOISE

FIELD OF THE INVENTION

This invention relates generally to internal combustion engines and, more particularly, to engines having fans for cooling liquid by air flow.

BACKGROUND OF THE INVENTION

Many types of internal combustion engines are liquid cooled and use a finned radiator through which hot engine coolant is routed to give up its heat to the atmosphere. And, typically, a rotating fan blows air through the radiator for heat exchange purposes. In a liquid-cooled engine, it is common to drive the fan at engine crankshaft speed. Liquid-cooled engines having radiator-type heat exchangers and fans for flowing air across such heat exchangers are used in such applications as motor vehicles and standby engine-generator sets used to provide standby (emergency) power for facilities such as hospitals, schools and the like.

It is well known that the horsepower available from an internal combustion engine is a function of torque (which, in turn, is a function of engine displacement) and speed. The equation expressing horsepower in terms of torque and speed is well known.

A way to obtain greater horsepower from an engine is to increase its speed and/or its displacement. And given an engine of a particular displacement, higher horsepower can be obtained by running the engine at higher speed. But faster engine speeds are attended by faster fan speeds and, necessarily, higher fan blade tip velocity, even though the increased fan speed is not needed to provide adequate cooling. The result is a noticeably-increased (and objectionable) noise level resulting from the fan.

Earlier workers in the field are not unaware of ways to change fan rotation speed relative to engine speed nor of the fact that high fan speed produces objectionable noise. For example, U.S. Pat. No. 3,763,835 (Miller et al.) discloses an engine cooling fan, the blades of which extend radially to maximum length when the fan is running at slower speed. And at higher fan speed, the blades become shorter because of a centrifugal, weight-actuated camming arrangement. A stated reason for the arrangement is to reduce high speed fan tip noise.

U.S. Pat. No. 2,995,295 (Day) discloses an arrangement for changing fan drive speed as a percentage of engine speed. The pulley concentric with the fan has two pulley members, the relative axial positions of which can be changed to change the effective diameter of the pulley.

In the arrangement disclosed in U.S. Pat. No. 3,872,842 (Medley), both the driving and driven pulleys are capable of having their effective diameters changed. Pneumatic controls are used for the purpose.

While these prior art arrangements have been satisfactory for the intended purpose, they are not without disadvantages. One involves mechanical complexity with seemingly-attendant propensity toward failure. The arrangement of the Miller et al. patent is an example.

Another disadvantage of certain prior art arrangements involves the matter of control of effective pulley diameter. The Medley patent discloses a pneumatic control arrangement which uses valves and temperature sensors to control fan speed.

An improved apparatus for reducing engine fan noise while yet avoiding complexities of certain prior art arrangements would be an important advance in the field of engine cooling.

OBJECTS OF THE INVENTION

It is an object of the invention to provide an improved apparatus which reduces engine fan noise and addresses some of the problems and shortcomings of the prior art.

Another object of the invention is to provide an improved apparatus which reduces engine fan noise and is mechanically simplified.

Another object of the invention is to provide an improved apparatus which reduces engine fan noise while yet avoiding the need for control equipment.

Yet another object of the invention is to provide an improved apparatus which reduces engine fan noise and is easy to use with existing internal combustion engines. How these and other objects are accomplished will become apparent from the following descriptions and from the drawings.

SUMMARY OF THE INVENTION

The new pulley apparatus has first and second pulleys driven by an internal combustion engine for powering an engine auxiliary function, e.g., a water pump, and an engine fan, respectively. The apparatus includes a tube-like arbor which is fixed with respect to the first pulley and has a first arbor surface. A bearing has first and second load-supporting surfaces and the first load-supporting surface is mounted to and supported by the first arbor surface. A collar-like fan drive member is mounted to and supported by the bearing and, more specifically, by the second load-supporting surface of such bearing. The fan and the second pulley are both coupled to the fan drive member.

In a preferred embodiment, the arbor has a wall and the first arbor surface is the exterior surface of such wall. The bearing contacts and circumscribes the wall and the fan drive member contacts and circumscribes the bearing.

While the new apparatus operates satisfactorily with but a single, properly selected bearing, the most preferred arrangement includes first and second ball bearings which are axially separated from one another by an annular spacer ring. Each bearing has an inner race, the inner or first load-supporting surface of which is against the arbor surface.

In another aspect of the invention, the first bearing is positionally secured along the length of the arbor by an abutment shoulder formed on the arbor. The first bearing is against such shoulder.

An annular spacer ring is between the first and second bearings and a retaining ring, e.g., a snap ring, is mounted to the arbor. Such retaining ring secures the first bearing against the abutment shoulder, secures the spacer ring against the first bearing and secures the second bearing against the spacer ring. To put this in other words, two bearings and the spacer ring between them are secured with respect to one another and with respect to the arbor by the arbor abutment shoulder on one end of the "stack" and by the retaining ring on the other.

The collar-like fan drive member is, in the highly preferred embodiment, around the outside of the bearings and a positioning shoulder is against the second bearing. A second retaining ring is mounted to the fan drive member and secures the fan drive member against the second bearing. The cooling fan is secured to the fan drive member and considered in axial relationship, such member is interposed between the fan and the first pulley.

The first and second pulleys are driven by first and second belts, respectively. Such belts are driven by engine-connected (crankshaft-powered) pulleys described below and the two belts and four pulleys are arranged in such away that the driven first and second pulleys rotate in opposite directions and about the same axis of rotation. And because of the relative diameters of the first and second pulleys and of the auxiliary and fan pulleys which drive them, respectively, the first and second pulleys rotate at different speeds. Most preferably, the second driven pulley (which has the fan coupled thereto) rotates at a speed significantly slower than that of the first driven pulley. In a specific embodiment, the first driven pulley rotates at or about engine speed.

When the apparatus is used in conjunction with an internal combustion engine, an exemplary engine has an auxiliary pulley and a fan pulley, both coupled to the engine crankshaft and rotating about the crankshaft axis of rotation. Such auxiliary and fan pulleys belt-drive the first and second pulleys, respectively. A conventional two-sided auxiliary belt has its first surface contacting the auxiliary pulley and its second surface contacting the first pulley. In a specific embodiment, the auxiliary belt has spaced-apart bar-like "teeth" on the side contacting the auxiliary pulley and the other belt side is smooth. To put this in other words, both sides of the auxiliary belt have pulleys bearing thereagainst.

On the other hand, the engine has a "V" type fan belt, the first or "V" surface of which contacts both the fan pulley coupled to the crankshaft and the second pulley coupled to the fan. Since the auxiliary and fan pulleys rotate in the same direction (and at the same speed), since the auxiliary and fan belts drive the first and second pulleys, respectively, and since opposite sides or surfaces of such belts are used to do so, the first and second pulleys rotate in opposite directions.

Other details of the invention are set forth in the following detailed description and in the drawings.

DETAILED DESCRIPTION OF PREFERRED EMBODIMENTS

Figure 1:
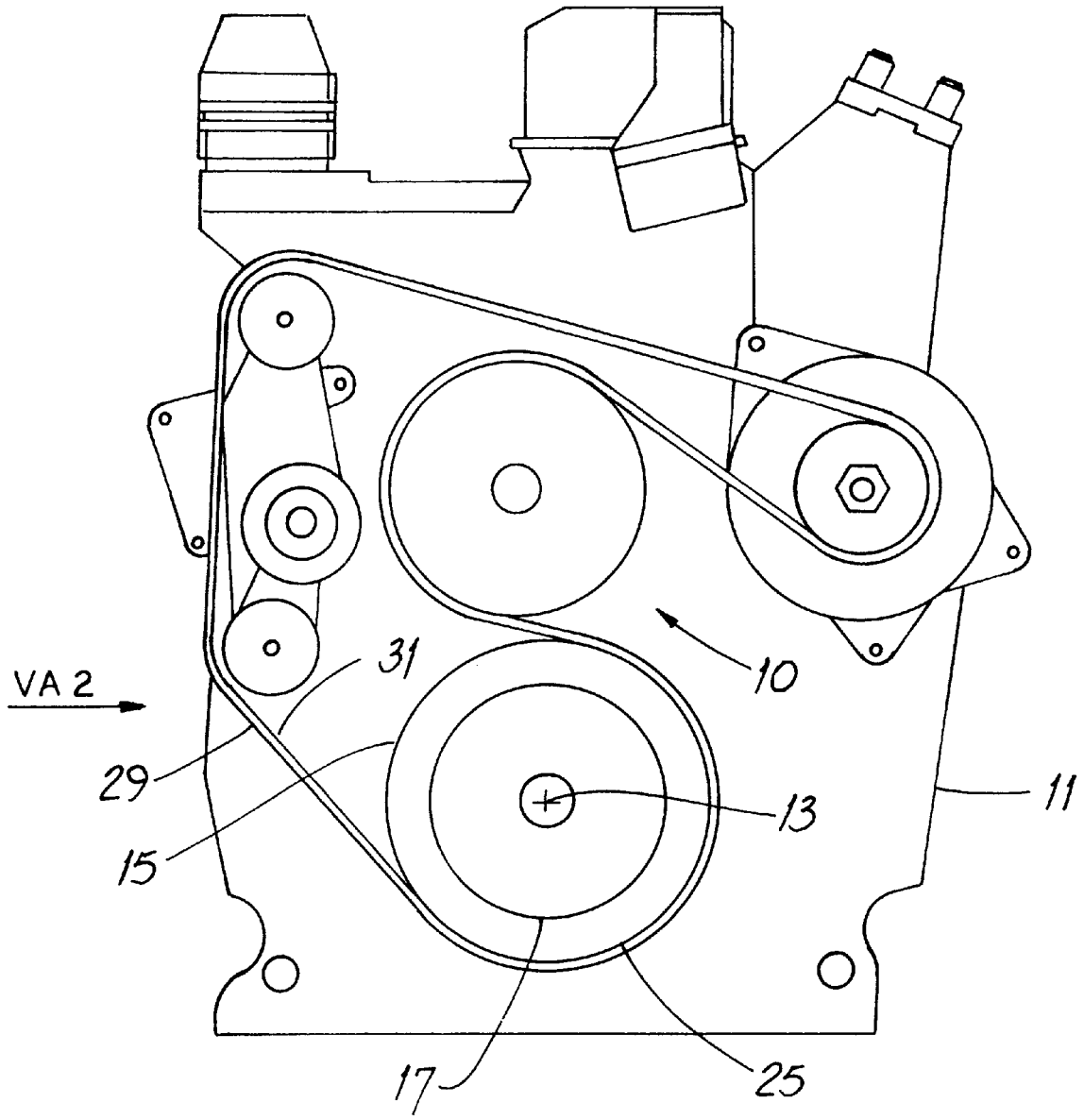
FIG. 1 is a front elevation view of the new pulley apparatus (shown as a representation) mounted on an internal combustion engine.
Figure 2:
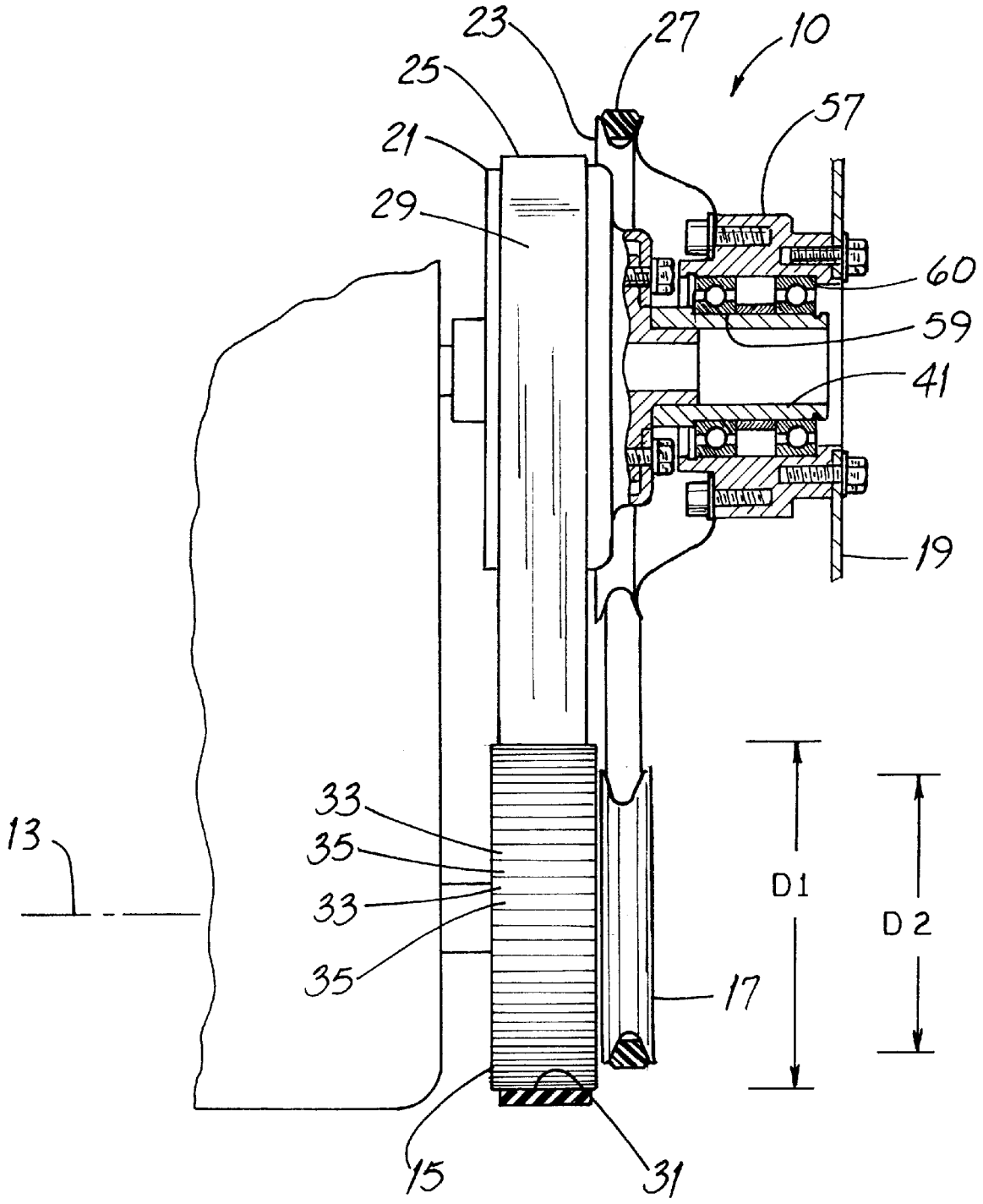
FIG. 2 is a side elevation view of the apparatus, engine and pulleys of FIG. 1 taken along the viewing axis VA2 thereof. Parts are shown in cross-section and other parts are broken away.
Figure 3:
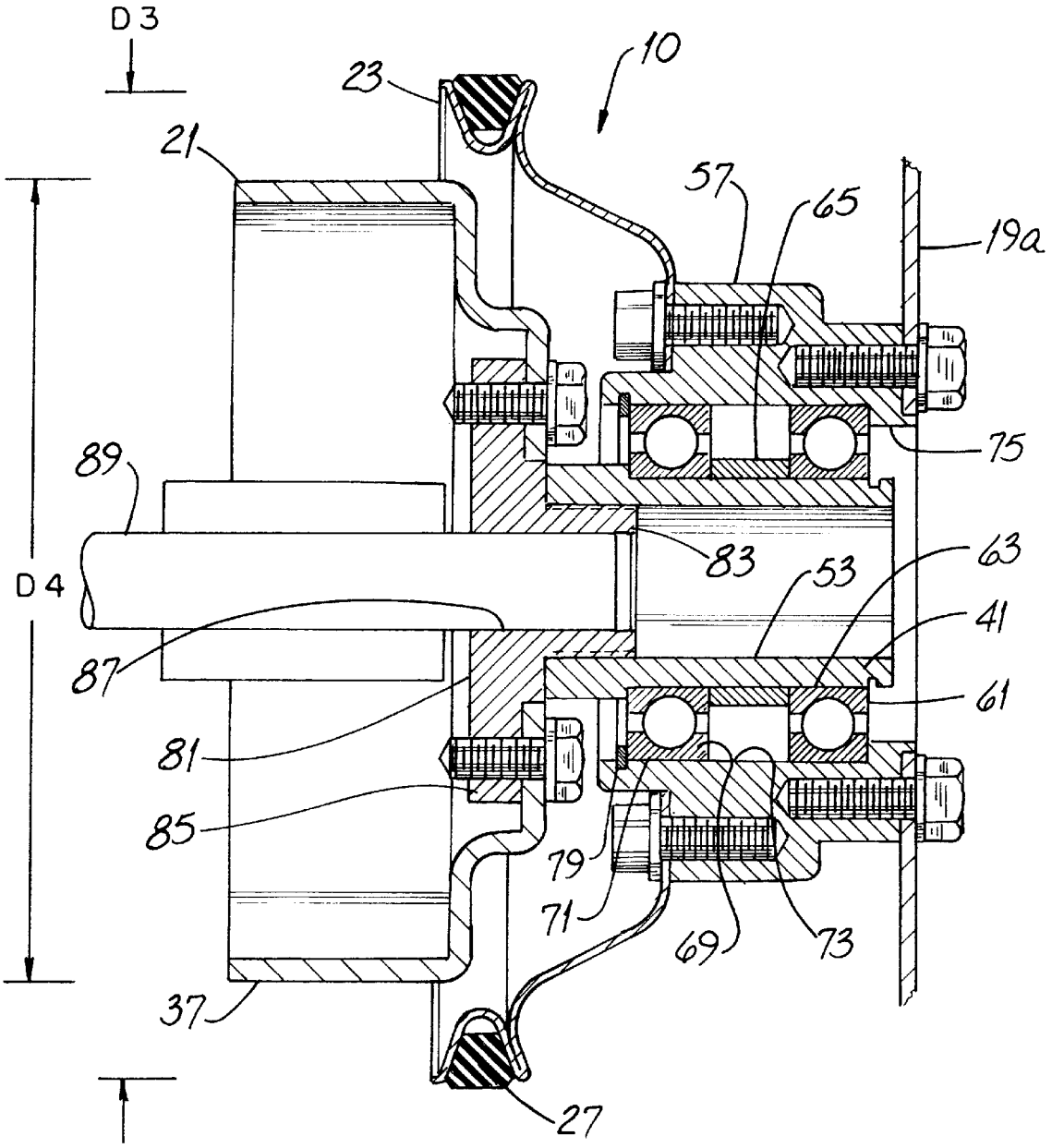
FIG. 3 is a side elevation view of the new pulley apparatus shown in conjunction with a water pump drive pulley. Parts are shown in cross-section, other parts are shown in full representation and still other parts are broken away.

Referring first to FIGS. 1, 2 and 3 the new pulley apparatus 10 will be described in connection with an internal combustion engine 11 having a crankshaft which rotates about an axis of rotation 13. Coupled to the crankshaft for rotation about the same axis 13 are an auxiliary pulley 15 and a fan pulley 17, so named because they drive an auxiliary function (such as a water pump) and a fan 19, respectively. In a specific embodiment, auxiliary pulley 15 drives the first or water pump pulley 21 and fan pulley 17 drives the second or fan pulley 23.

Two drive belts 25, 27 are used in the arrangement. The first belt 25 has a first surface 29 which is smooth and flat. That is, such surface 29 is free of teeth or the like. The second surface 31 of the belt 25 has spaced-apart, rectangular bar-like teeth extending across the width of the belt 25 and having a notch between each pair of adjacent teeth. Belts of this type are sometimes referred to as "poly V" belts. The auxiliary pulley 15 has teeth 33 which are shaped and spaced so that when the pulley 21 is being driven, each tooth 33 engages a notch in the belt 25 and each groove 35 between adjacent pairs of teeth 33 receives a belt tooth. The pulley 15 and the belt surface 31 thereby engage one another in gear fashion.

As particularly shown in FIGS. 1 and 2, the first belt 25 is wound "serpentine-fashion" so that both of its surfaces 29, 31 are used for driving. The circumferential outer surface 37 of the first driven pulley 21 is smooth so as to frictionally engage the first, smooth surface 29 of the first belt 25 without causing undue belt wear.

As shown in FIGS. 2 and 3, the second belt 27 is a V-belt. Such belt 27 engages both the driving fan pulley 17, coupled to the engine crankshaft, and the driven second pulley 23 which is coupled, to the air-moving cooling fan 19.

Figure 4:
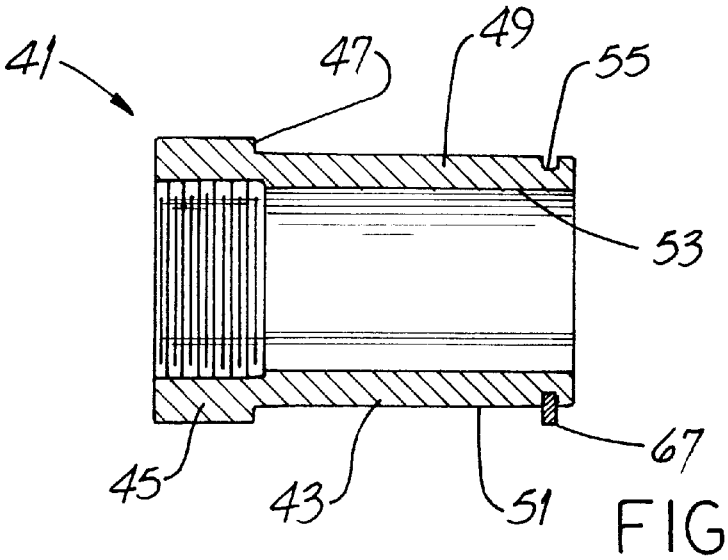
FIG. 4 is a side elevation view, in cross-section, of the preferred embodiment of an arbor, a component of the pulley apparatus.

Referring also to FIG. 4, the apparatus 10 includes a tube-like arbor 41 having a cylindrical support portion 43, an enlarged (with respect to the portion 43) cylindrical shoulder portion 45 and a flat, annular abutment shoulder 47 between the portions 43, 45. The support portion 43 is formed by the arbor wall 49 which has a smooth first arbor surface 51 and an interior surface 53. A snap-ring groove 55 is adjacent to the end of the portion 43 and its purpose is described below.

While a single bearing of the proper type could be used between the arbor 41 and the fan drive member 57, a highly preferred embodiment includes two ball bearings 59, 60 each having an inner race 61 with its first load-supporting surface 63 mounted to and supported by the first arbor surface 51. The inner race 61 and the arbor 41 are mounted to one another in a known way that prevents the race 61 from rotating with respect to the arbor 41.

The bearings 59, 60 are axially separated from one another by an annular spacer ring 65 contacting the arbor surface 51 and the inner races 61. The first bearing 59 is against and positionally secured along the length of the arbor 41 by the abutment shoulder 47.

A retaining ring 67, e.g., a snap ring, is mounted in the groove 55. Such retaining ring 67 secures the first bearing 59 against the abutment shoulder 47, secures the spacer ring 65 against the first bearing 59 and secures the second bearing 60 against the spacer ring 65. To put this in other words, two bearings 59, 60 and the spacer ring 65 between them are secured with respect to one another and with respect to the arbor 41 by the arbor abutment shoulder 47 on one end of the "stack" and by the retaining ring 67 on the other.

Each bearing 59, 60 also has an outer race 69 with its second load-supporting surface 71 contacting the interior surface 73 of the fan drive member 57 which circumscribes the arbor 41 and the bearings 59, 60. The outer races 69 and the fan drive member 57 are mounted to one another in a known way that prevents the races 69 from rotating with respect to the member 57.

The fan drive member 57 includes a radially-inwardly-extending positioning shoulder 75 against the outer race 69 of the second bearing 60. A second retaining ring 79 is mounted to the fan drive member 57 and cooperates with the shoulder 75 to axially, positionally secure the fan drive member 57 with respect to the bearings 59, 60. The fan 19

(and, specifically, the fan hub 19*a*) is bolted to an end of the drive member 57 and the driven pulley 23 is bolted to the other end of such member 57.

The apparatus 10 also includes a mounting flange 81 having a reduced-diameter stud end 83 threaded to the interior surface 53 of the arbor 41 and secured with, e.g., LOKTITE® adhesive, so that the arbor 41 and the flange 81 are fixed with respect to one another. The flange 81 also has an enlarged diameter disc-shaped head 85 to which is bolted the first pulley 21 driven by the pulley 15 and belt 25 shown in FIGS. 1 and 2. The flange 81 has an interior wall 87 to which is press-fitted the drive shaft 89 of, in the exemplary embodiment, the engine water pump. (In the exemplary embodiment, the pulley 21, flange 81 and shaft 89 are supplied by the engine manufacturer.)

Referring again to FIG. 2, it is to be noted that the effective diameter D1 of the auxiliary pulley 15 is greater than the diameter D2 of the driving fan pulley 17. And it is apparent from FIG. 3 that the driven fan pulley 23 has an effective diameter D3 greater than the diameter D4 of the driven water pump pulley 21. Since both of the engine-mounted pulleys 15, 17 rotate at the same speed (i.e., angular velocity or revolutions per minute), the driven fan pulley 23 will rotate at a speed significantly below that of the driven water pump pulley 21. And by virtue of the fact that the driven water pump pulley 21 is driven by what might be termed the "back side" of the belt 25 (i.e., by surface 29), the pulleys 21, 23 rotate in opposite directions.

Figure 5:
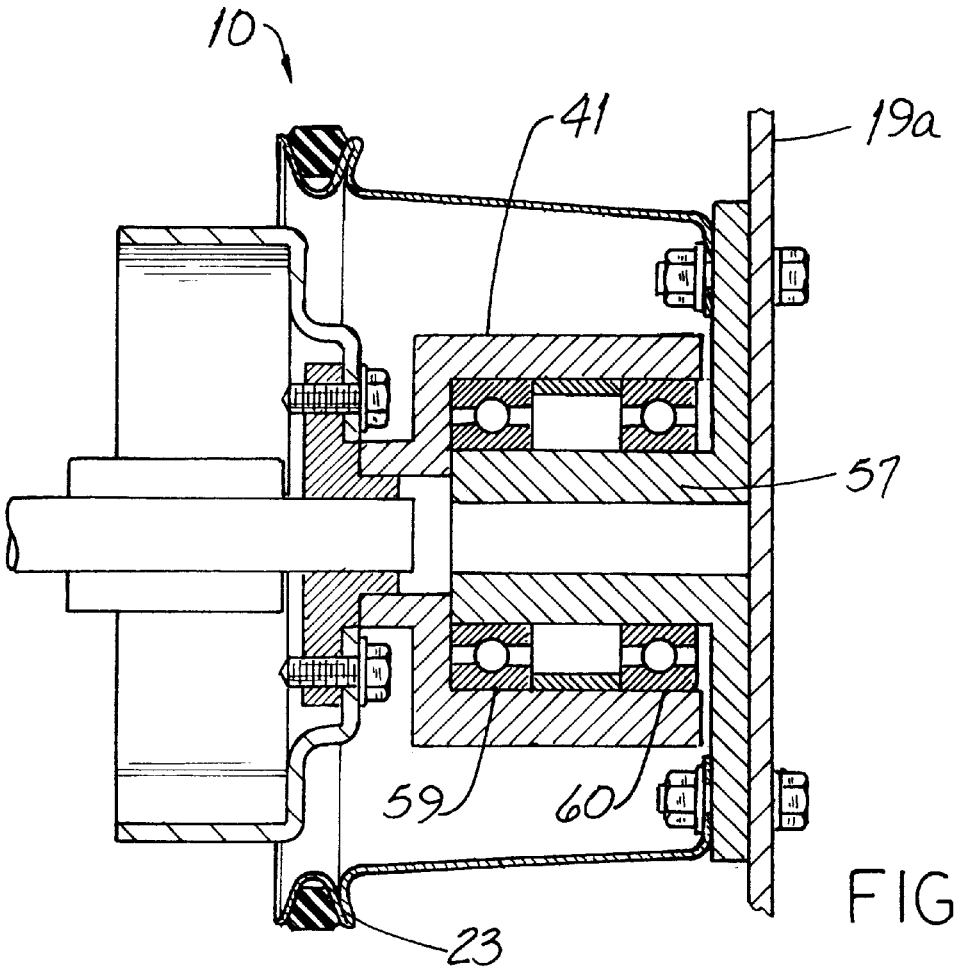
FIG. 5 is a side elevation view of another, less-preferred embodiment of the pulley apparatus. Parts are shown in cross-section, other parts are shown in full representation and still other parts are broken away.

While the principles of the invention have been shown and described in connection with but a few preferred embodiments, it is to be understood clearly that such embodiments are by way of example and are not limiting. That point is illustrated in FIG. 5 which depicts, in simplified form, what might be termed an "inside-out" (and less preferred) arrangement of the apparatus 10. The bearings 59, 60 are mounted inside the arbor 41 and the fan drive member 57 is mounted inside the bearings 59,60. The pulley 23 and fan hub 19*a* are both bolted to such member 57.

What is claimed:

1. An apparatus for rotating the driving shaft of an engine auxiliary function and an engine fan, the apparatus including:

a first pulley having central hub mounted to the driving shaft, the central hub defining a threaded connection surface;

an arbor threaded onto the connection surface of the central hub of first pulley for rotation therewith and having a first arbor surface;

a bearing having first and second load-supporting surfaces, the first load-supporting surface being mounted to the first arbor surface;

a fan drive member mounted to the second load-supporting surface and to the engine fan; and a second pulley coupled to the fan drive member.

2. The apparatus of claim 1 wherein:

the first pulley is driven by a first belt;

the second pulley is driven by a second belt; and the pulleys rotate in opposite directions when driven.

3. The apparatus of claim 2 wherein the pulleys rotate at different speeds when driven.

4. The apparatus of claim 3 wherein the pulleys rotate about the same axis of rotation.

5. In an internal combustion engine having first and second pulleys driven by the engine crankshaft for powering an auxiliary function and a fan, respectively, the improvement wherein:

the first pulley is mounted to a driving shaft;

an arbor removably mounted to the first pulley for rotational movement therewith and having a first arbor surface;

a bearing has first and second load-supporting surfaces and the first load-supporting surface is mounted to the first arbor surface;

a fan drive member is mounted to the second load-supporting surface; and the fan and the second pulley are coupled to the fan drive member.

6. The engine of claim 5 wherein:

the first and second pulleys are driven by first and second belts, respectively; and the second pulley rotates at a speed slower than the rotational speed of the first pulley.

7. The engine of claim 6 wherein the pulleys rotate about the same axis of rotation and in opposite directions.

8. The engine of claim 7 wherein:

the arbor has a wall and the first arbor surface is on the exterior of the wall;

the bearing circumscribes the wall; and the fan drive member circumscribes the bearing.

9. The engine of claim 5 wherein the bearing is a first bearing and the engine includes a second bearing having a first load-supporting surface mounted to the first arbor surface and wherein:

the arbor has an abutment shoulder and the first bearing is against the abutment shoulder;

a spacer ring is between the first and second bearings;

a retaining ring is mounted to the arbor; and the retaining ring secures the first bearing against the abutment shoulder, secures the spacer ring against the first bearing and secures the second bearing against the spacer ring.

10. The engine of claim 9 wherein the retaining ring is a first retaining ring and:

the fan drive member includes a positioning shoulder against the second bearing; and a second retaining ring is mounted to the fan drive member securing the fan drive member against the second bearing.

11. The engine of claim 10 wherein:

the fan is secured to the fan drive member; and the fan drive member is interposed between the fan and the first pulley.

12. The engine of claim 5 wherein the crankshaft has an axis of rotation and the engine includes:

an auxiliary pulley and a fan pulley, both coupled to the crankshaft for rotation about the axis of rotation; and an auxiliary belt having a first surface contacting the auxiliary pulley and a second surface contacting the first pulley.

13. The engine of claim 12 wherein the engine includes:

a fan belt having a first surface contacting the fan pulley and the second pulley, thereby rotating the first and second pulleys in opposite directions of rotation.

* * * * *